United States Patent [19]

McGill

[11] 4,440,230

[45] Apr. 3, 1984

[54] FULL-BORE WELL TESTER WITH HYDROSTATIC BIAS

[75] Inventor: Howard L. McGill, Lufkin, Tex.

[73] Assignee: Schlumberger Technology Corporation, New York, N.Y.

[21] Appl. No.: 220,240

[22] Filed: Dec. 23, 1980

[51] Int. Cl.[3] ..... E21B 34/06

[52] U.S. Cl. ..... 166/321; 166/324; 166/250

[58] Field of Search ..... 166/321, 324, 250, 374; 73/151

[56] References Cited

U.S. PATENT DOCUMENTS

| | | | |
|---|---|---|---|
| Re. 29,638 | 5/1978 | Nutter | 73/151 |
| 3,964,305 | 6/1976 | Wray | 166/321 |
| 4,064,937 | 12/1977 | Barrington | 166/321 |
| 4,105,075 | 8/1978 | Helmus | 166/321 |
| 4,144,937 | 3/1979 | Jackson | 166/314 |

*Primary Examiner*—William F. Pate, III

[57] ABSTRACT

In accordance with an illustrative embodiment of the present invention, a pressure controlled well tester apparatus having a full-bore ball valve closure element includes valve actuator means responsive to changes in the pressure of fluids in the well annulus for moving the ball valve between its open and closed positions, and bias means responsive to the hydrostatic pressure of fluids in the well bore for assisting in moving the ball valve to its fully closed position.

4 Claims, 2 Drawing Figures

FULL-BORE WELL TESTER WITH HYDROSTATIC BIAS

FIELD OF THE INVENTION

This invention relates generally to drill stem testing, and particularly to a new and improved full-bore test tool having means responsive to the hydrostatic head of well fluids for assisting in moving the valve closure element, typically a rotatable ball, from open to closed position.

BACKGROUND OF THE INVENTION

To conduct what commonly is known as a drill stem test, a packer and a test valve are lowered into a well on a pipe string and the packer is set to isolate the formation interval to be tested from the hydrostatic pressure of fluids thereabove. The test valve is then opened and closed to alternately flow and shut in the formations while pressure recorders make a record of the pressures as a function of time. From the pressure record, many useful formation parameters or characteristics can be determined. Usually, a sample of the produced formation fluids is recovered.

For drill stem testing in the offshore environment, a test system has been developed which includes a test valve element that is moved between its open and closed positions in response to the application and release of pressure to the well annulus between the pipe string and the well bore wall. This system includes a housing having a spring biased valve actuator mandrel slidably disposed therein, and having oppositely facing pressure surfaces that are arranged such that one face is selectively subjected to the pressure of fluids externally of the housing through the medium of a compressible fluid such as nitrogen gas, while the other face is always subjected to the pressure of fluids externally of the housing body. Thus, during lowering of the tools into a fluid filled well bore, the valve actuator mandrel is balanced with respect to hydrostatic, and the pressure of the compressible medium rather precisely reflects the value of hydrostatic pressure externally of the housing.

The compressible medium is contained in a chamber within the housing, and the hydrostatic head is applied to the chamber by way of a pressure channel that is adapted to be closed at test depth and prior to initiation of the test. Upon closing of the pressure channel the hydrostatic pressure value is "memorized" in the chamber. With the chamber closed, the application of pressure to the fluid in the annulus will develop a pressure differential across the oppositely facing pressure surfaces of the valve mandrel to force it against the bias of a return spring in one longitudinal direction, and a release of the applied pressure will enable the valve mandrel to return in the other longitudinal direction. The foregoing test valve system is disclosed and claimed in the Nutter U.S. Pat. No. Re. 29,638, assigned to the assignee of the present invention, and provides a pressure responsive valve actuator system that is particularly advantageous for use in offshore drill stem testing because the pressure that is applied to the well annulus to operate the valve actuator is a substantially fixed value for any depth in the well that a test may be conducted.

Although the valve actuator system described in the Nutter patent has been widely used, when the system is used to actuate a full-bore test valve element such as a ball valve, difficulty can be encountered in fully reclosing the ball element after it has been opened. This is because the closing force that is applied to shift the actuator mandrel in the closing direction is generated primarily by a coil spring which delivers decreasing pressure as it extends from its compressed to its extended or relaxed length. The pressure that the spring can deliver to effect a fully closed position of the ball valve can be inadequate, particularly under conditions of high formation fluid flow rates. Other factors that inhibit closing of a ball valve include relatively high friction forces that are present due to sliding cam and seal surfaces, which forces may be increased due to presence of debris in the well fluids.

It is an object of the present invention to provide a new and improved pressure controlled tester valve of the type described that can be closed reliably under relatively high flow rate and friction conditions.

Another object of the present invention is to provide a new and improved pressure control tester valve that utilizes the hydrostatic head of the well fluids to assist in closing a balltype closure valve.

SUMMARY OF THE INVENTION

These and other objects are attained in accordance with the concepts of the present invention through the provision of a fluid pressure controlled well tester apparatus that includes a housing adapted for connection in a pipe string and having a flow passage extending therethrough for conducting formation fluids from an isolated formation interval. Full opening valve means, such as a ball valve or the like, is provided for opening and closing the flow passage in response to longitudinal movement of an actuator that is shifted in one longitudinal direction by an increase in well annulus pressure to cause the valve to open, and is shifted in the opposite longitudinal direction to cause the valve to close as the increase in well annulus pressure is reduced. To assist in shifting the actuator in said opposite direction, there is included in combination a bias means that is responsive to the hydrostatic pressure of fluid in the well bore and which acts in concert with the closing spring to supply a substantially increased closing force to the actuator to insure that the ball valve is rotated to its fully closed position.

BRIEF DESCRIPTION OF THE DRAWINGS

The present invention has other features and advantages which will become more clearly apparent in connection with the following detailed description of a preferred embodiment, taken in conjunction with the appended drawings in which.

DESCRIPTION OF A PREFERRED EMBODIMENT

Figure 1:
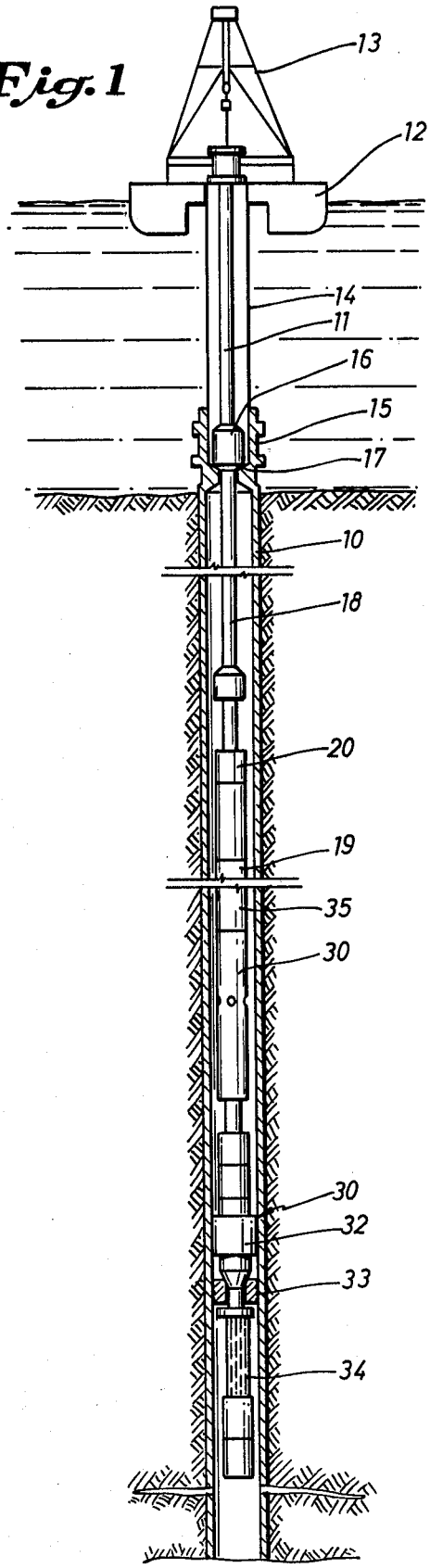
FIG. 1 is a somewhat schematic view of a drill stem test being conducted in an offshore well from a floating drilling vessel.

Referring initially to FIG. 1, there is illustrated an offshore well which normally is lined by a casing 10 and into which extends a pipe string 11 that extends upward to a floating drilling vessel 12 having a derrick 13 for handling the pipe string. A riser 14 will usually extend from a subsea wellhead assembly 15 upward to the vessel 12 which is anchored or otherwise held on station above the well. The pipe string 11 can include a control valve assembly 16 of typical design that has a landing shoulder 17 that seats in the well head assembly 15 so that the pipe string can be suspended from a fixed point not subject to the vertical motion that the vessel 12 experiences due to the action of waves and tides. Preferably, the pipe string 11 comprises a major section 18, such as a length of drill pipe, and a minor section 19 such as a predetermined length of drill collars having a known weight, with the pipe strings being connected together by a slip joint-safety valve tool 20 of the type disclosed in U.S. Pat. No. 4,141,418, Nutter, assigned to the assignee of this invention. The lower end of the minor pipe section 19 may be connected to the upper end of the pressure controlled tester valve tool 30 that is constructed in accordance with the principles of this invention, which is in turn connected to a well packer 31 that includes packing elements 32 to seal off the well bore and slips 33 to anchor at the proper level above the well interval to be tested. The packer 30 can be generally of the type shown in U.S. Pat. No. 3,399,727, McGill, assigned to the present assignee, and suspended below the packer is a perforated nipple 34 to enable fluid entry during the test. Suitable pressure recorders are provided to make a record of the pressures of the fluid versus time as the test proceeds. Other typically used equipment such as a safety joint and jar can be connected between the control valve 30 and the packer 32 but are shown only schematically to simplify this disclosure. A tubing pressure responsive reverse circulating valve 35 as disclosed and claimed in U.S. application Ser. No. 253,786, Upchurch, may be connected in the pipe string above the upper end of the test valve 30.

Figure 2:
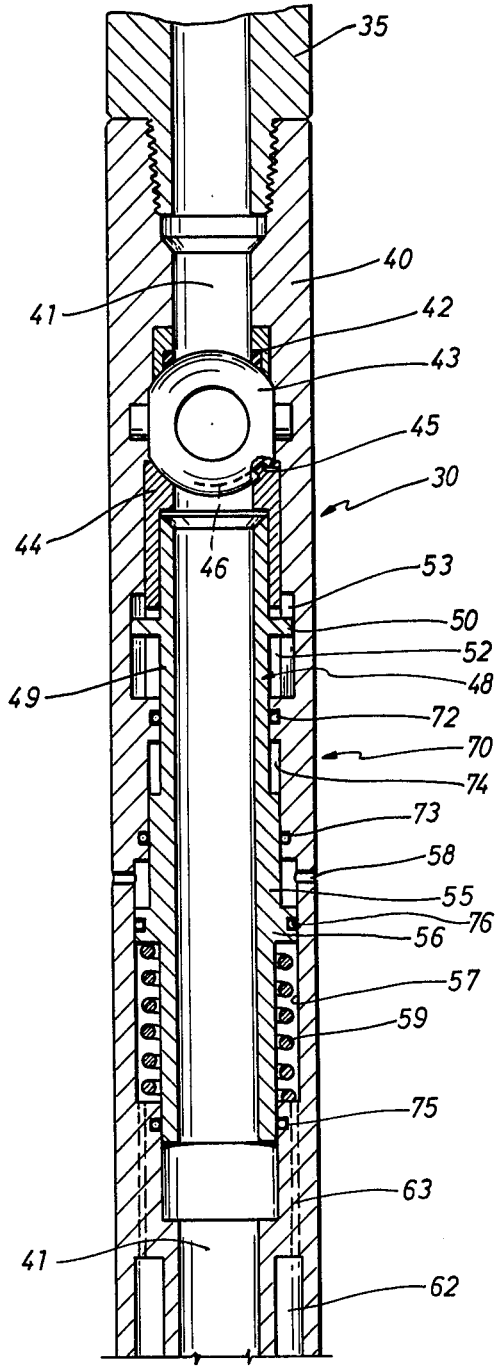
FIG. 2 is a cross-sectional view of a full-bore well tester valve apparatus that includes a hydrostatic bias in accordance with the present invention.

As shown in detail in FIG. 2, the test valve 30 includes an elongated tubular housing 40 having a flow passage 41 extending longitudinally therethrough. A valve seat 42 surrounds the flow passage 41 and cooperates with a ball valve element 43 to control fluid flow through the passage 41. The ball valve 43 may be of typical construction and is mounted for rotation about an axis that is transverse to the flow passage by trunions that engage in radial openings in the housing 40. The ball valve 43 is shifted between its open and closed positions in response to rotation of an actuator tube 44 that is mounted coaxially of the housing 40. The tube 44 carries a drive pin 45 on its upper end that slidably engages in a circumferentially extending slot 46 formed in the periphery of the ball 43, and in a manner that such rotation of the sleeve 44 in one direction will shift the ball open and in the opposite direction will shift the ball closed.

An elongated actuator mandrel 48 is slidably disposed for upward and downward movement within the housing 40. The upper end portion 49 of the mandrel 48 carries oppositely directed cam pins 50 that extend through helical slots 52 in the tube 44 and into vertically extending spline grooves 53 in the interior walls of the housing 40. Thus as the actuator mandrel 48 is moved downward from the position shown in FIG. 2, such movement is translated to rotation in one direction of the tube 44 through the action of the pins 50, slots 52 and grooves 53; upward movement of the mandrel 48 is translated to rotation of the tube 44 in the opposite rotational direction. Such rotational movements shift the ball valve 43 between its open and closed positions as described above. Although the foregoing describes broadly the actuation of the valve, further details of the construction and operation thereof are disclosed in U.S. Pat. No. 4,105,075 issued Aug. 8, 1978 which is incorporated herein by reference.

The lower portion 55 of the mandrel 48 carries a piston 56 that is sealingly slidable within a cylinder 57 formed in the housing 40 below one or more ports 58 that communicate annulus fluid pressure to the upper face of the piston. A coil spring 59 reacts between the lower face of the piston 56 and an upwardly facing shoulder on the housing to bias the mandrel 48 upwardly. A chamber 62 formed in a lower portion of the housing 40 contains a compressible medium such as nitrogen gas, and the chamber is communicated with the region below the piston 56 by one or more vertically extending ports 63. Of course, the piston 56 and the lower portion 55 of the mandrel 48 are sealed with respect to the adjacent housing walls 57 and 64 by appropriate seals to prevent fluid leakage. The nitrogen chamber 62 and the return spring 59 form upper portions of a hydrostatic pressure reference system of the type described and claimed in the Nutter U.S. Pat. No. Re. 29,638, which also is incorporated herein by reference.

A hydrostatic bias system indicated generally at 70 is provided in combination with the foregoing elements in accordance with the present invention. The system 70 includes a stepped diameter portion of the mandrel 48 that is sealed with respect to the housing 40 by upper and lower seals 72 and 73 arranged on different diameters, the lower seal diameter being somewhat larger than the upper seal diameter. The region 74 between the mandrel 48 and the housing 40 thus is sealed off and contains air initially at atmospheric or other low pressure. The seals 72 and 75 can be located on the same diameter, and provided the seal 73 is located on a larger diameter, an upwardly directed force will be exerted on the mandrel 48 that is the product of the hydrostatic pressure of the well fluids in the annulus adjacent the housing 40 and the transverse cross-sectional area that is defined by the difference in the diameters of sealing engagement of the seals 72 and 73. This force will act in series with and thus add to the bias of the return spring 59 in shifting the mandrel 48 upwardly to cause closing movement of the ball valve 43.

OPERATION

In operation, the parts are assembled as shown in the drawings and prepared for use by injecting a charge of nitrogen gas into the cavity 62 through suitable closable ports (not shown). The charge pressure may be, for example, in the neighborhood of 2500 psi for most tests, but is not critical. A guide that can be used is to have a charge pressure about 500 psi less than the estimated hydrostatic pressure at test depth. The actuator mandrel 48 will be in its upper position, as shown in FIG. 2, to correspondingly position the ball valve 43 in the closed position. The string of testing tools then is lowered from the vessel 12 into the well casing 10 until the packer 30 is located at the proper point above the formation interval to be tested. At an elevation in the well considerably above the setting point, the hydrostatic head of fluids will have become in excess of the precharged pressure of the gas within the cavity 62, and of course the floating piston (not shown) that defines the lower end of the chamber 62 will have moved upwardly somewhat as it transmits the hydrostatic head pressure in the well to the compressible gas in the chamber. In any event, the actuator mandrel 48 remains in its upper position because essentially the same pressure is acting on the opposite faces of the piston 56, and a gradually increasing upwardly directed bias force is being applied to the mandrel 48 as the tools are lowered into the well bore due to the hydrostatic pressure acting through the ports 58 on a cross section of the mandrel 48 that is outlined by the diameters of sealing engagement of the seals 72 and 73.

The length of the minor pipe string 18 is selected to provide the proper amount of weight to set the packer 30, and the landing shoulder 17 is located in the major string 18 at the proper spacing such that when the packer is anchored at setting depth, and the pipe 11 is suspended in the subsea well head 15, the slip joint 20 is in an at least partially closed or contracted condition to enable the weight of the drill collars 19 to be applied via the test tools to the packer 30. The packer 30 is conditioned for setting by appropriate manipulation with the pipe string, resulting in expansion of the slips 33 and compression and expansion of the packing elements 32 into sealing engagement with the wall of the casing 10. The transmission of pressure from the well annulus to the gas contained in the chamber of 62 is closed off by suitable means such as described in the above-mentioned Nutter U.S. Pat. No. Re. 29,638 so that the pressure of the gas in the chamber 62 becomes a reference pressure for further actuation of the test tool 30.

With the blow-out preventers at the well head assembly 15 closed in a typical manner so that the well is completely under control, a formation test can be conducted in the following manner: fluid pressure is applied by surface pumps and control lines (not shown) to the well annulus between the pipe string 11 and the well casing 10, and the increase in pressure adjacent to housing 40 is transmitted by the housing ports 58 to the upper face of the mandrel piston 56. When the downward force due to applied pressure becomes sufficient to overcome the upwardly directed bias force as previously described, the actuator mandrel 48 will be shifted downwardly against the bias of the coil spring 59. Downward movement causes rotation of the actuator tube 44 and consequent movement of the ball valve 43 to its open position where the bore therethrough is axially aligned with the flow passage 41. The valve is left open for a period of time sufficient to draw down the pressure in the isolated well bore interval below the packer 30 to enable connate fluids within the formation to be produced into the well bore. After a sufficient time lapse, the applied pump pressure is bled off at the surface, to enable the coil spring 57 and the upwardly directed bias force that is being applied to the actuator mandrel 48 to shift the same upwardly, thus causing closing movement of the ball valve 43. The presence of the bias force, having a magnitude that is directly related to depth in the well, insures that the ball valve will be rotated to its fully closed position, even though such closing movement may be resisted due to high fluid flow rate, seal friction, cam friction and other factors. The valve member 43 is left in the closed position for a shut-in period of time during which the pressure recorders make a record of pressure build-up data. Pressure can be repeatedly applied to the annulus and then released to obtain additional flow and shut in pressure data.

To terminate the test, the pipe string 11 is lifted straight upwardly thereby extending the slip joint 20 and lifting the drill collars 19 and the tester housing 40 to remove the weight thereof from the packer 30. A bypass associated with the packer is open to equalize pressures thereacross, so that the packing elements 32 can be retracted. As the housing 40 is elevated with respect to the packer apparatus 30, the annulus pressure transmissions path is again opened so that the pressure of the nitrogen gas in the chamber 62 can experience a gradual decrease to the original precharge pressure as the hydrostatic head is reduced during withdrawal of tools from the well.

It now will be recognized that a new and improved full bore test valve apparatus has been provided that includes means responsive to the hydrostatic head of well fluid for assisting in moving the ball closure element from its open to its fully closed position. Since certain changes or modifications may be made in the structural detail of the present invention without departing from the inventive concepts involved, it is the aim of the appended claims to cover all such changes and modifications falling within the true spirit and scope of the present invention.

What is claimed is:

1. A fluid pressure controlled well tester apparatus comprising: housing means adapted for connection to a pipe string and having a flow passage extending therethrough for conducting formation fluids from an isolated formation interval; full-opening valve means for opening and closing said flow passage; a stepped-diameter mandrel that is longitudinally movable and sealingly slidable within said housing means; first seal means between a lesser diameter portion of said mandrel and said housing means and second seal means between a greater diameter portion of said mandrel and said housing means, said first and second seal means being arranged to define an atmospheric chamber for maintaining a quantity of gas at less than the annulus hydrostatic head pressure; and means subjecting a transverse cross-sectional area of said mandrel to changes in the pressure of fluids in the well annulus for moving said mandrel to shift said valve means between closed and open positions in such manner that movement of said mandrel to the valve open position will cause expansion of said atmospheric chamber to bias the mandrel in the valve closed position.

2. The apparatus of claim 1, wherein said housing means includes a shoulder and said mandrel includes an oppositely facing shoulder; and wherein said apparatus further comprises a spring element reacting between said shoulders for urging said mandrel into the valve closed position.

3. The apparatus of claim 2, wherein said valve means comprises a ball element that is rotatable about an axis that is transverse to said flow passage; and wherein said means for moving said mandrel to shift said valve means includes axial cam means for causing rotation of said ball element about said axis in response to longitudinal movement of said mandrel.

4. The apparatus of claim 3, wherein said mandrel moving means comprises means for moving said mandrel downwardly within said housing to cause opening of said valve means and means for moving said mandrel upwardly within said housing means to cause closing of said valve means; and wherein said housing means shoulder is an upwardly facing shoulder and said mandrel shoulder is a forwardly facing shoulder.

* * * * *